United States Patent [19]

Hauz

[11] 4,333,414

[45] Jun. 8, 1982

[54] SUBMERSIBLE TWIN-HULL WATERCRAFT

[75] Inventor: Gerhard Hauz, Waldbronn, Fed. Rep. of Germany

[73] Assignee: Gunther Rudi Laukien, Fed. Rep. of Germany

[21] Appl. No.: 87,001

[22] Filed: Oct. 22, 1979

[30] Foreign Application Priority Data

Oct. 24, 1978 [DE] Fed. Rep. of Germany ..... 2846154

[51] Int. Cl.[3] ..... B63G 8/41

[52] U.S. Cl. ..... 114/322; 114/315; 114/323; 114/333; 114/335; 405/189; 405/192; 114/61

[58] Field of Search ..... 114/56, 61, 312, 313, 114/314, 315, 322, 323, 324, 325, 330, 331, 334, 335, 337, 338; 405/188, 189, 192, 193

[56] References Cited

U.S. PATENT DOCUMENTS

| | | | |
|---|---|---|---|
| 1,159,683 | 11/1915 | Keller | 114/323 |
| 1,929,168 | 10/1933 | Grieshaber | 114/323 |
| 2,948,247 | 8/1960 | Rebikoff | 114/315 |
| 3,851,491 | 12/1974 | Mason | 405/188 |
| 4,010,619 | 3/1977 | Hightower | 114/322 |
| 4,164,195 | 8/1979 | Frigeni | 114/322 |

*Primary Examiner*—Trygve M. Blix
*Assistant Examiner*—D. W. Keen

[57] ABSTRACT

A submersible watercraft has at least one watertight hull and a diver-exit vessel adapted to accommodate a diver is detachably connected to the watercraft by a sealable diver-exit port which enables divers to pass between the diver-exit vessel and the watercraft. The diver-exit vessel has a buoyancy and hauling apparatus such as a pair of ropes link the diver-exit vessel to the watercraft when the diver-exit vessel is not docked at the diver-exit port.

7 Claims, 1 Drawing Figure

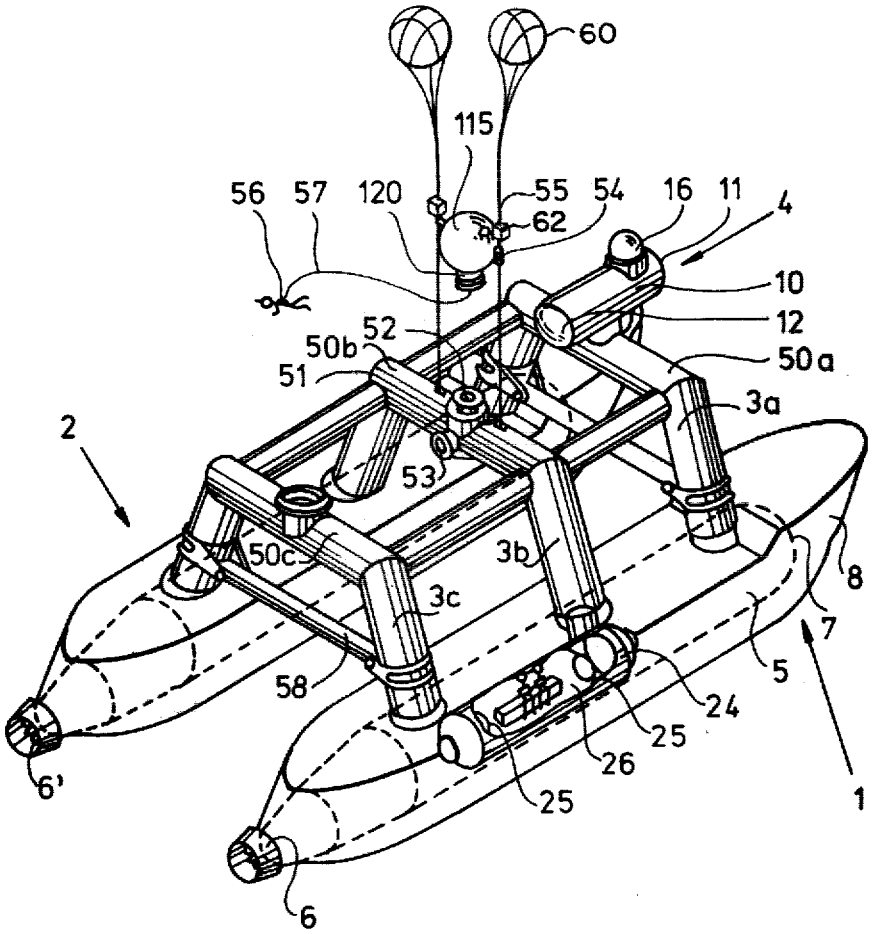
60
115
56
57
120
55
54
16
11
4
62
10
12
52
50b
50a
51
3a
2
53
50c
3b
8
3c
7
5
58
24
25
26
6'
25
1
6

SUBMERSIBLE TWIN-HULL WATERCRAFT

TECHNICAL FIELD

The present invention relates to submersible watercraft; in particular, to a submersible watercraft having two hulls disposed generally parallel to and spaced apart from each other. A pilot's cab having a pressure vessel with viewing ports and a steering stand for the watercraft is disposed generally above the hulls approximately in a longitudinal symmetry plane. The two hulls and the pilot's cab are rigidly interconnected by tubular struts. The two hulls contain propulsion and control mechanisms and are adapted to accommodate between them a submersible craft, a diver work chamber, pipeline repair gear or other operating equipment. A diver-exit vessel adapted to accommodate a diver is detachably connected to the watercraft by means of a sealable diver-exit port which enables divers to pass between the diver-exit vessel and the watercraft. Hauling means such as a pair of ropes link the diver-exit vessel to the watercraft when the diver-exit vessel is not docked at the diver-exit port.

BACKGROUND ART

Experience with oil and natural-gas exploration, production and transmission in the North Sea has shown that, because of the frequent bad weather, surface vessels can be deployed in such work only on a limited scale. The time spent coming and going from and to the nearest port to avoid storms represents a major loss of working time for surface vessels engaged in the North Sea project.

Underwater craft suited for undersea work usually are relatively small and can be employed only in conjunction with a mother ship on the surface. When the mother ship has to leave the area because of impending bad weather, it is forced to take the dependent submersible craft along, even though the submersible craft could in principal avoid the heavy sea conditions by submerging below a relatively shallow depth.

Submersible craft with a surface buoy serving as power-supply unit are similarly affected by bad weather.

German Offenlegungsschrift No. 23 56 537 discloses a catamaran surface vessel having a submersible gondola located between the two hulls of the catamaran. The catamaran remains afloat when the gondola is lowered for underwater travel. The submersible gondola has a torpedo-like shape widely used for self-propelled underwater craft because of its low resistance to motion for the volume of water displaced, relative to other shapes. Although the catamaran, by virtue of the form stability provided by its two spaced-apart hulls, has a high resistance to capsizing, it is nonetheless susceptible to bad weather and rough seas as are other surface vessels.

U.S. Pat. No. 1,757,174 to Douglas discloses a seagoing vessel having five pontoons: a cabin pontoon, two waterline pontoons, and two power pontoons. The two waterline pontoons are disposed below and to either side of the cabin pontoon. A power pontoon is disposed below each waterline pontoon. The vessel of the '174 patent is a surface vessel. Only the power pontoons, located beneath the waterline pontoons, are submerged when the vessel is under way. Consequently, the vessel is also affected by heavy seas.

German Offenlegungsschrift No. 28 12 758 discloses a watercraft which may be employed as floating and submersible operating equipment which may be deployed under a wide variety of weather conditions. That watercraft includes a first submersible hull and a second submersible hull disposed generally parallel to and spaced apart from one another. The two submersible hulls are constructed in the manner of submarines, having watertight pressure housings and ballast tanks which may be flooded and blown. The submersible hulls also include propulsion units for motive power and steering mechanisms for control of the craft. The watercraft further includes a submersible pilot's cab disposed generally above the hulls approximately in a longitudinal symmetry plane defined between the two hulls. The pilot's cab includes a watertight pressure vessel and can function as a buoyancy body in that its weight is less than the weight of water it displaces by the pressure vessel when submerged. The watercraft further includes tubular struts rigidly interconnecting the hulls and the pilot's cab. The struts have at least sections which are constructed as pressure-resistant bodies which have a net buoyancy.

An advantage in subsea operations is that the craft rests firmly on the floor with its two hulls and leaves a sheltered working space between them. The craft can therefore be positioned to straddle a line on which work is to be done.

While work on the ocean floor, at depths permissible for divers, may be carried out with the prior-art systems, the work radius of a diver is limited by an umbilical cord connected between the diver and the submerged vessel, or by the diver's ability to find his way back to the diver-exit chamber if he is untethered. Of course, such a limitation in the horizontal is less onerous because it can be overcome by proper location or by changing the location of the submersible. However, it is not readily possible to reach work sites located much above the ocean floor.

It is also known to lower diver chambers constructed as autonomous pressure bodies, such as diving bells, from surface vessels to the depth at which the work site is located. However, such operations are highly dependent on the weather and are generally uneconomical, especially in reaches of the sea where the weather frequently is bad, as in the North Sea, for example, since they can be usefully employed only for a short time in relation to the time spent coming and going.

DISCLOSURE OF THE INVENTION

The present invention has as its object to provide a submersible watercraft which is constructed in such a way that divers may be employed to carry out work at any desired level above the seabottom or below the water surface.

The work to be done at different levels between the sea-bottom and the sea surface frequently consists of repair and maintenance work on exploration and production platforms which are located on or above the water surface and which rest on piling or have other structural members extending far downward, and often all the way to the seabottom. It is not possible for a submersible to dock at the underwater part of such structures because of the hazards to the structure and to the submersible which this would entail because of changing currents, for example.

Broadly, the submersible watercraft of the present invention includes a hull, with watertight walls and ballast tanks adapted to be flooded and blown for varying the buoyancy of the watercraft. A diver-exit vessel is detachably connectable to the watercraft, the diver-exit vessel being constructed as a pressure vessel to accommodate a diver. Hauling means are provided for linking the diver-exit vessel to the watercraft.

In this arrangement in accordance with the invention, when the watercraft rests on the ocean floor, the diver-exit pressure vessel can be detached from the submerged craft and allowed to ascend, while continuing to be linked to the craft through hauling means such as ropes or chains. Once the diver-exit pressure vessel has reached a desired level, paying out of the hauling means is halted and the divers are able to leave the pressure vessel at the approximate level of their work site and to perform the work while the submerged craft stably rests on the seabottom and the diver-exit pressure vessel is suspended, much like a captive balloon, relatively undisturbed below the zone influenced by the state of the surface of the sea. After the divers have returned to the pressure vessel, the latter can be hauled in and docked at the craft. Before or after docking, the divers can reach the interior of the craft, and specifically a decompression chamber, through an air lock accessible after docking or through another diver-exit port of the craft.

In this operating mode, it is advantageous that diver work sites at any desired subsea level can be reached by divers surely and safely, and that neither the submersible watercraft nor the structure on which work is to be done will be endangered, since the watercraft need not dock at the structure. On the other hand, the underwater mission is virtually unaffected by the weather conditions prevailing on the surface. The divers may make use of the installations and facilities aboard the submerged craft and return to it after having completed their mission. In operations of longer duration, an additional shuttle capsule may be used as a link between diver-exit pressure vessel and the submerged watercraft to transport divers from the watercraft to the diver-exit pressure vessel and back. A further advantage is that diving missions may be carried out in areas where the depth of the sea is greater than the permissible depth for a diver. The permissible sea depth then is determined solely by the permissible diving depth of the watercraft, since pressures less than ambient pressure may be maintained within the diver-exit pressure vessel while it is at a depth greater than the depth limit for an untethered diver. In this case, however, the transfer from submerged watercraft to diver-exit chamber and back must be made through an air lock enterable after the diver-exit pressure vessel has docked with the watercraft.

On the other hand, when the use of the system described is limited to reaches not deeper than the depth limit for untethered divers, there will be no need to provide means for docking the diver-exit pressure vessel with the craft. The transfer from the diver-exit pressure vessel to the craft then can take place through the water and appropriate exit port of the watercraft. However, embodiments are preferred wherein the diver-exit pressure vessel is adapted to dock by its exit port with the craft. A closable docking port then is preferably disposed at the top of the watercraft, which makes it readily possible to bring the exit port, ordinarily disposed on the underside of the diver-exit pressure vessel, into alignment with the docking port, thus providing for passage between submersible craft and diver-exit pressure vessel. However, it is also possible, and in preferred embodiments of the invention contemplated, to locate the docking port on the side of the watercraft. In this case, the diver-exit pressure vessel is either swung around prior to docking, with the transfer again taking place through the exit port of the diver-exit pressure vessel, or the diver-exit pressure vessel is provided with an additional closable side opening which is used for docking and is opened after docking. It is not absolutely necessary that an air lock be provided next to the docking port in the submersible watercraft since the diver-exit pressure vessel may be constructed in such a way that it is completely closed or closable after docking, with the pressure in the diver-exit chamber then being adjusted to the pressure in the craft, following which the divers can make the transfer. Generally, however, the arrangement will be such that the docking port gives direct access to a decompression chamber, which can then be placed under any desired pressure and, specifically, under ambient pressure to protect the divers from decompression accidents. The required decompression can then be accomplished in the decompression chamber.

The diver-exit pressure vessel is preferably constructed so that in the operating condition it will be buoyant. In this case, it will suffice to attach a hauling means such as a rope or chain to the diver-exit pressure vessel and to pay out this hauling means gradually in order to position the diver-exit pressure vessels at the desired working level. Alternatively, the arrangement may be such that while the diver-exit pressure vessel itself has no buoyancy, a buoyancy body is attached to the hauling means or to the pressure vessel.

In preferred embodiments of the invention, at least two hauling means in the form of ropes are provided which are run through eyes attached to the largest horizontal periphery of the diver-exit pressure vessel. The hauling means may be fastened to these eyes or simply run through them, in which case they serve solely as guiding means. In the latter case, the hauling means preferably extend upwardly from the diver-exit pressure vessel and are kept taut by buoyancy bodies fastened to their ends. Brakes are then mounted on the outside of the diver-exit pressure vessel which are adapted to be released and to be actuated from the inside, and which permit the diver-exit pressure vessel to be fixed at the desired level. The vertical motion of the diver-exit pressure vessel may be produced by means of tanks in said chamber adapted to be flooded and blown out, and which generate positive or negative buoyancy, depending on the degree to which they are filled. Alternatively, the diver-exit pressure vessel may have positive buoyancy at all times and may be moved in the vertical direction by an additional hauling means through a winch which pays it out or hauls it in.

BRIEF DESCRIPTION OF THE DRAWINGS

Further details and variants of the present invention will become apparent from the following description, in conjunction with the claims, of an embodiment illustrated in the simplified, diagrammatic drawing, where a perspective view of a submersible with a detachable diver-exit chamber is shown.

BEST MODE FOR CARRYING OUT THE INVENTION

The watercraft shown has a first hull 1 and a second hull 2, each of which is rigidly connected to a pilot's cab 4, disposed above the two hulls 1 and 2, by means of struts *3a*, *3b*, *3c* which are inclined towards a vertical longitudinal symmetry plane defined between the two hulls and also inclined towards a vertical transverse plane passing through the hulls and which approach each other toward the top. The two hulls 1 and 2 have outwardly the same shape, and each consists of an elongated, essentially cylindrical hull pressure vessel 5 whose after end tapers to propulsion units 6 and 6' and whose forward end is formed by a generally hemispherical section 7. The hulls 1 and 2 are constructed as submarines. The hull pressure vessel 5 is surrounded by a fairing 8 which determines the outer shape of the hulls 1 and 2. The struts 3*a*, 3*b*, 3*c* are constructed as pressure-resistant tubes which are joined at one end to a hull pressure vessel 5 and at the other end to three cross struts 50*a*, 50*b*, 50*c*, the joints at both ends being water-tight and connecting corresponding pairs of struts 3*a*, 3*b*, 3*c*. A pilot's cab 4 is mounted on the front cross strut 50*a*. Disposed in the middle of the center cross strut 50*b* is a chamber 51 which has a top docking port 52 and a side docking port 53. The pilot's cab 4 has a pressure vessel comprising a cylindrical, elongate body 10 whose ends are provided with forward and aft hemispherical sections 11 and 12, respectively. The elongate body 10 is provided in the area of the pilot's compartment 14 with viewports 16 and contains a steering stand (not shown) for piloting the vessel. Passage from the pilot's cab pressure vessel 4 to the hulls 1 and 2 and vice versa is possible through the struts 3*a*, which are constructed as passageways. The forward struts 3*a* terminate in areas of the hull pressure vessel 5 which are under atmospheric pressure. A relatively small compartment 24, which is bounded by two pressure-resistant bulkheads 25, adjoins at both ends a decompression chamber 26.

Compressed-gas tanks (not shown) are accommodated in an after area of the hull 1, while an internal-combustion engine (not shown) driving an electric generator which supplies the craft with power is housed, in a space closed off by bulkheads, in an after area of the hull 2. In addition to or in place of the electric generator, a hydraulic pump may be provided to supply corresponding systems with a working medium.

To be able to shift the transition of the craft from the form-stabilized condition (surface operation) to the weight-stabilized condition (submerged operation) into a desired range of the semisubmerged condition, additional buoyancy bodies (not shown) adapted to be flooded and blown are preferably disposed between the struts 3*a*, 3*b*, 3*c* and surrounded by suitable fairing to reduce to water resistance in the submerged and semisubmerged condition. Struts 3*a*, 3*b*, 3*c* are also preferably enclosed by suitable fairing. Such fairing is conventional and need not be described. To increase the mechanical stability, the two hulls 1 and 2 are preferably interconnected by cross struts in the forward and after areas, discussed below.

A diver-exit pressure vessel 115 which contains a diver-exit chamber can be connected to one of these two docking ports, which when so connected is joined to it in a rigid and pressure-resistant manner. On its underside, the spherical diver-exit pressure vessel has a diver-exit shaft 120 at whose lower end appropriate flanges, sealing and mounting means are disposed. The diver-exit pressure vessel 115 is provided with lateral guide eyes 54 through each of which a hauling means 55 is run. Fastened to the ends (not shown) of the hauling means 55 extending upwardly from the diver-exit chamber 115 are buoyancy bodies (also not shown), which maintain the hauling means 55 in approximately vertical position. Through appropriate flooding and blowing means, the diver-exit pressure vessel 115 can be balanced so that it has virtually no buoyancy, or has positive or negative buoyancy. Moreover, it is provided with clamping means for making fast to the hauling means 55, said clamping means being constructed as brakes which may be actuated, released and applied from the inside.

Normally the diver-exit pressure vessel 115 is firmly attached to one of the two docking ports 52 or 53. When the craft has submerged and rests on the seabottom, the diver-exit pressure vessel 115, which has been entered by the working divers, is released and blown to give it positive buoyancy so that it is able to ascend along the hauling means 55, which have first been paid out, to the level on which the work site for the divers is located. A pair of buoyancy bodies 60 attached to the first and the second ropes respectively, maintain the two ropes taut in operation. Further, a pair of brakes 62 are provided which are releasable and actuable from inside the diver-exit vessel to act upon the first and the second ropes, respectively, to arrest the vessel 115 at any desired height. A diver 56, connected to the diver exit-chamber through an umbilical cord 57, is able to leave said chamber, through the diver-exit shaft 120, after it has been placed under ambient pressure. On completion of the work, the diver 56 returns to the diver-exit chamber 115, and the braking means can then be released, after the diver-exit shaft 120 has been closed, if desired, with the diver-exit chamber 115 then beginning its descent after the desired negative buoyancy has been brought about by flooding. Once the diver-exit chamber 115 has reached the vicinity of the chamber 51, it can start to dock at the docking port 52 or 53. After docking, the diver or divers can leave the diver-exit chamber within the diver-exit pressure vessel 115 and reach the decompression chamber 26 through the center cross strut 50*b*, the strut 3*b*, and the compartment 24.

Instead of the described design of the diver-exit pressure vessel 115, in which it is provided with flooding and blowing means and with a releasable brake for making fast to the hauling means 55, the diver-exit pressure vessel 115 may also be constructed so that under water it always has buoyancy. In this case, the hauling means are fastened directly to the guide eyes 54 and the diver-exit chamber 115 is caused to ascend by paying out the hauling means 55, and caused to descend by hauling them in. To this end, there is mounted on the center cross strut 50*b* a suitable winch which pays out or hauls in the hauling means (preferably two), constructed as steel cable.

To increase the mechanical stability of the interconnection between the two hulls, additional cross struts 58 are preferably provided which increase the stability of form of the system or reduce the stresses, respectively.

The submersible watercraft of the present invention is provided with suitable power-supply units and other conventional requisite equipment. The engineering details of such equipment are not necessary for an understanding of the present invention and, for conciseness, will not be described.

It is not intended to limit the present invention to the specific embodiments described above. It is recognized that changes may be made in the apparatus specifically described herein without departing from the scope and teachings of the instant invention, and it is intended to encompass all other embodiments, alternatives and modifications consistent with the present invention.

I claim:

1. A submersible watercraft, comprising;

a pair of spaced hulls with watertight walls and ballast tanks adapted to be flooded and blown for varying the buoyancy of the craft, a plurality of tubular members for rigidly interconnecting said hulls, each of the tubular members extending between the hulls and having at least a section which is pressure-resistant and weighing less than the volume of water displaced by the section when it is submerged, so that the watercraft has the stability of a catamaran when surfaced, is weight stable when completely submerged, and when partially submerged with the two hulls substantially completely below the mean waterline the tubular members are at least partly above the mean waterline, a sealable docking port mounted in one of said tubular members adapted to permit passage into the interior of the watercraft, a diver-exit vessel detachably connectable to said docking port having a sealable opening for the entering and exit of a diver, the diver-exit vessel being constructed as a pressure vessel to accommodate a diver, and having ballast means adapted to be independently flooded and blown for varying the bouyancy thereof, means for sealably detachably joining the diver exit vessel to the docking port enabling transfer therebetween underwater, and means for guiding the ascent and descent of the diver-exit vessel relative to the watercraft comprising a first rope and a second rope, each rope being attached at one end to the watercraft, and in which the diver-exit vessel is fitted with a first eye and a second eye, the two eyes being located respectively at opposite points on a largest horizontal periphery of the diver-exit vessel, the first and the second ropes passing respectively through the first and the second eyes.

2. The watercraft according to claim 1 including a pressure vessel mounted on one of said tubular members defining a pilots cab having control means for operating said watercraft, viewports and hatch means enabling transfer between said pressure vessel and said watercraft.

3. The watercraft according to claim 1 wherein said docking port is mounted on the upper surface of said tubular member.

4. The watercraft according to claim 1 wherein said docking port is mounted on the side surface of said tubular member.

5. The watercraft according to claim 1 wherein said means for guiding said diver-exit vessel includes a fluid bouyant body secured to said first rope and a second bouyant body secured to said second rope, said boyant bodies acting to maintain said ropes taut in a vertical direction.

6. The watercraft according to claim 5, including brake means actuable from within said diver-exit vessel, said brake means coacting with at least one of said ropes to clamp therewith and releasably arrest the movement of said diver-exit vessel relative thereto.

7. The watercraft according to claim 1, wherein at least one of said hulls contains a pressure chamber and at least one of said tubular members on which said docking part is mounted is in direct communication with said pressure chamber.

* * * * *